United States Patent [19]

BUM/u/ hler et al.

[11] 4,398,913

[45] Aug. 16, 1983

[54] PROCESS FOR PRODUCING DISCHARGE RESERVE PRINTS ON TEXTILE MATERIALS

[75] Inventors: Ulrich Buhler, Schoneck; Joachim Ribka, Offenbach am Main; Kurt Roth, Hofheim; Theo Stahl, Frankfurt am Main, all of Fed. Rep. of Germany

[73] Assignee: Cassella Aktiengesellschaft, Frankfurt am Main, Fed. Rep. of Germany

[21] Appl. No.: 304,099

[22] Filed: Sep. 21, 1981

[30] Foreign Application Priority Data

Nov. 8, 1980 [DE] Fed. Rep. of Germany ..... 3042144

[51] Int. Cl.[3] ..... D06P 5/12

[52] U.S. Cl. ..... 8/456; 8/464; 8/532; 8/549; 8/638; 8/639; 8/694; 8/922

[58] Field of Search ..... 8/456, 464, 532, 638, 8/694

[56] References Cited

U.S. PATENT DOCUMENTS

| | | | |
|---|---|---|---|
| 2,083,308 | 6/1937 | Senn | 260/207 |
| 3,398,135 | 8/1968 | Mueller | 8/693 |
| 3,398,137 | 8/1968 | Mueller | 260/207 |
| 3,972,677 | 8/1976 | Feess et al. | 8/464 |
| 4,252,530 | 2/1981 | Ribka et al. | 8/457 |
| 4,265,629 | 5/1981 | Ribka et al. | 8/449 |
| 4,314,811 | 2/1982 | Feess et al. | 8/449 |
| 4,314,812 | 2/1982 | Feess | 8/449 |

FOREIGN PATENT DOCUMENTS

| | | |
|---|---|---|
| 1512321 | 6/1978 | United Kingdom . |
| 1543724 | 4/1979 | United Kingdom . |

OTHER PUBLICATIONS

"Research Disclosure", vol. 198, No. 19826, pp. 425–427, (Oct. 1980).

*Primary Examiner*—A. Lionel Clingman
*Attorney, Agent, or Firm*—Connolly and Hutz

[57] ABSTRACT

In the process for production of discharge reserve prints on textile material comprised of water-repellent fibers or water repellent fibers mixed with cellulose fibers, wherein a disperse dyestuff which is dischargeable to white is applied in the form of a dye liquor or printing paste to the textile material after which said material is dried or incipiently dried, and a discharge reserve printing paste is printed on the material in the desired pattern, and the thus treated material is subsequently subjected to a heat treatment at temperatures of 100° to 230° C., the improvement comprises said disperse dyestuff which is dischargeable to white is a dyestuff of the formula

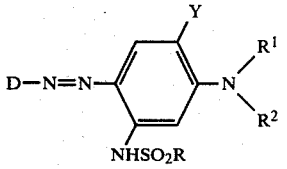

as more fully defined herein and wherein said discharge reserve printing paste contains, as the discharging agent, a base which produces a pH value of at least 8 in a 5% strength aqueous solution.

12 Claims, No Drawings

PROCESS FOR PRODUCING DISCHARGE RESERVE PRINTS ON TEXTILE MATERIALS

The present invention relates to a process for producing discharge reserve prints on textile materials which consist of water-repellent fibres, preferably polyester fibres, or contain such fibres mixed with cellulose fibres, wherein a disperse dyestuff which is dischargeable to white and, if appropriate, a disperse dyestuff which is resistant to discharging agents are applied in the form of a dye liquor or printing paste to the textile material and the latter is then dried or incipiently dried, and a discharge reserve printing paste which, if appropriate, in addition to the discharging agent, also contains dyestuffs with resistance to discharging agents, is printed on in the desired pattern, and the goods are subsequently subjected to a heat treatment at temperatures of 100° to 230° C.

In textile printing it has always been a problem to produce white or coloured, sharply defined patterns on a deeply coloured background. In particular, direct printing on the textile material fails completely when producing filigree-like patterns on a dark background. For the production of such designs it is known to print a discharge paste in the desired pattern on a deep background dyeing which has been prepared with a dyestuff dischargeable to white, and then to destroy, by means of dry or wet heat treatment, the dyestuff at the areas which have been printed with the discharge paste. The desired pattern is obtained as white on a dark ground after the prints thus obtained have been washed. It is also already known to add, to the discharge printing pastes, dyestuffs which are resistant to the discharging agent. In this case, dyeing of the textile material by means of the indestructible dyestuff is carried out on the printed areas simultaneously with the destruction of the ground dyeing. Coloured prints on a dark ground are obtained in this case. Coloured prints on a dark ground can also be obtained if the dark ground is produced by means of a mixture of a dischargeable dyestuff and a non-dischargeable dyestuff of another colour.

In applying these known processes to synthetic fibre materials or textile materials consisting preferentially of water-repellent synthetic fibres, a problem arises in that it is very difficult to discharge polyester fibres which have been dyed, for example, with disperse dyestuffs. Once disperse dyestuffs have been fixed, that is to say dissolved, in the polyester fibre, they are largely removed from access by aqueous agents and thus also from attack by aqueous discharge pastes. In the production of discharge prints on textile materials containing water-repellent fibres or consisting of water-repellent fibres, the known discharge printing process is, therefore, modified by first padding the textile material with a dye liquor containing disperse dyestuff and drying or incipiently drying it, it being necessary, however, that no fixation of the dyestuff, that is to say solution of the dyestuff in the water-repellent fibre, takes place. The desired pattern is then printed, by means of the discharge printing paste, onto the padded fabric which has been dried or incipiently dried, and the padded and printed fabric is then subjected to a heat treatment, in the course of which the ground dyestuff, in the areas which have not been printed, simultaneously migrates into the polyester, that is to say becomes fixed, and, in the printed areas, the dyestuff is destroyed, that is to say no dyeing takes place. In view of this mechanism, this process is also known as discharge reserve printing.

The process of discharge reserve printing, which is in itself simple, contains a number of technical difficulties which frequently hinder its use. Thus, it is as a rule not easy to destroy the ground dyestuff completely by means of the discharging agent. If this cannot be done, a coloured residue the shade of which can vary from yellow-brown to dull violet or reddish-tinged grey shades remains behind on the discharged areas and stains the white ground on the discharged areas. This results in white discharges which appear smudgy, or, in the event that a coloured discharge is to be produced, leads to adulteration of the shade of the dyestuff which is resistant to discharging agents. This difficulty is overcome by using discharge pastes containing relatively strong reducing agents or oxidising agents, such as, for example, sodium dithionite in combination with an alkali, alkali metal formaldehyde-sulphoxylates or even heavy metal salts, such as, for example, tin-II chloride. Although it is possible, as a rule, to achieve a satisfactory white discharge print by means of strong discharging agents of this type, damage of the fibre material frequently occurs, particularly if the polyester fibre also contains accompanying fibres, such as, for example, cellulose fibres. Furthermore, these discharging agents are, as a rule, not cheap and, in the case of heavy metal discharging agents, they constitute an additional ecological pollution or cause additional outlay for purifying the effluent. In addition, there are only relatively few types of dyestuff which are resistant to discharging agents of this type, so that the choice of dyestuffs which are resistant to discharging agents and which can be used for producing coloured discharges is relatively small.

Overcoming these difficulties requires disperse dyestuffs for the background dyeing, which can be discharged to give pure white, using agents having as mild an action as possible. Disperse dyestuffs the molecule of which contains at least two esterified carboxyl groups are disclosed in German Offenlegungsschriften No. 2,612,740, 2,612,741, 2,612,742, 2,612,790, 2,612,791 and 2,612,792. Dyestuffs of this type are saponified when treated with aqueous alkalis, forming alkali-soluble dyestuffs containing carboxylate groups. The use of dyestuffs of this type as disperse dyestuffs for dyeing polyester materials has the advantage that residues of dyestuff which have not been fixed can be washed out of the textile material by a simple treatment with agents having an alkaline action. It is also already known that residues of dyestuffs which have not been fixed can be removed easily from dyeings made with disperse dyestuffs containing pyridone derivatives as a coupling component, by treating the fibre with alkali. However, these dyestuffs which are soluble in aqueous alkalis have the disadvantage, insofar as pyridone dyestuffs are concerned, that they can, in the main, only be employed for yellow or reddish-tinged yellow shades, and, insofar as dyestuffs containing esterified carboxyl groups are concerned, that they have, after the saponification of the ester groups, a certain affinity for hydrophilic fibres, such as, for example, wool, cotton or polyamide fibres, and they stain or soil these fibres. In addition, the diazo and/or coupling components required for the manufacture of dyestuffs containing carboxylic acid ester groups are not substances customary in large-scale chemical industry, but have to be separately manufactured for these types of dyestuffs, which, as a rule, is uneconomical. The types of dyestuffs indicated above have not, therefore, made it possible to satisfy the need to employ disperse dyestuffs which can be discharged to give pure white under relatively mild discharge conditions in the process of discharge reserve printing on water-repellent textile materials.

It has now been found, surprisingly, that the difficulties in carrying out discharge reserve printing on textiles consisting wholly or mainly of water-repellent synthetic fibres can be overcome if disperse dyestuffs which are dischargeable to white and, if appropriate, disperse dyestuffs which are resistant to discharging agents are applied, in the form of a dye liquor or printing paste, to these materials in a manner which is in itself known, the fabric is then dried or incipiently dried and is subsequently printed in the desired pattern with a discharge reserve printing paste which, if appropriate, in addition to the discharging agent, also contains a disperse dyestuff which is resistant to discharging agents, if the disperse dyestuff, dischargeable to white, which is employed is a dyestuff of the formula I

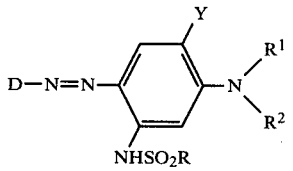

wherein R denotes alkyl which has 1 to 4 C atoms and which can also be substituted by hydroxyl, chlorine, bromine, methoxy, methoxyethoxy, ethoxyethoxy or alkanoyloxy having a total of 2 to 4 C atoms, or denotes phenyl which can also be monosubstituted or polysubstituted by nitro, chlorine, bromine and/or methyl, $R^1$ denotes alkyl which has 1 to 4 C atoms and which can also be substituted by hydroxyl, chlorine, bromine, cyano, phenyl, phenoxy, alkanoyloxy having 2 to 4 C atoms, phenoxyacetoxy, alkylaminocarbonyloxy having 1 to 4 C atoms in the alkyl radical, or phenylaminocarbonyloxy, or denotes dihydroxyalkyl having 3 or 4 C atoms, chlorohydroxyalkyl having 3 or 4 C atoms, or alkyl which has 3 to 10 C atoms and in which the carbon chain is interrupted by 1 to 3 oxygen atoms and which can be monosubstituted or polysubstituted by hydroxyl, $R^2$ denotes one of the meanings of $R^1$ and additionally hydrogen, alkoxycarbonylalkyl which has 1 to 4 C atoms in the alkyl group and 1 or 2 C atoms in the alkoxy group and which can also be substituted additionally by hydroxyl, methoxy, ethoxy, chlorine, bromine or cyano, phenoxycarbonyloxy, cyclopentyl, cyclohexyl, phenyl or alkenyl having 3 to 5 C atoms, Y denotes hydrogen, chlorine, bromine, alkyl having 1 to 4 C atoms, alkoxy which has 1 to 4 C atoms and which can also be substituted by alkoxycarbonyl having 1 to 4 C atoms in the alkoxy group, cyano, alkanoyl having a total of 2 to 4 C atoms, or hydroxyl, or denotes dihydroxyalkoxy having 3 or 4 C atoms, chlorohydroxyalkyl having 3 or 4 C atoms, or alkoxy which has 3 to 10 C atoms and in which the carbon chain is interrupted by 1 to 3 oxygen atoms and which can be monosubstituted or polysubstituted by hydroxyl, D denotes a radical of the formula

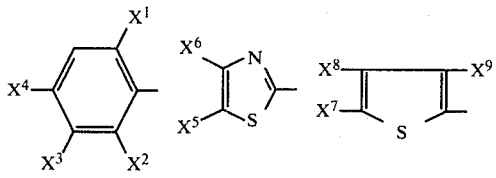

(II) (III) (IV)

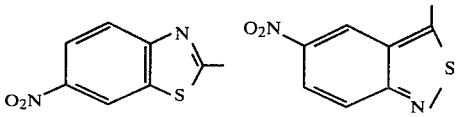

(V) (VI)

wherein $X^1$ denotes nitro, cyano, alkylsulphonyl having 1 to 4 C atoms, phenylsulphonyl, dialkylphosphone having 1 to 4 C atoms in each of the alkyl radicals, trifluoromethyl or alkoxycarbonyl which has 1 to 2 C atoms in the alkoxy radical and which can also be substituted additionally by hydroxyl, chlorine, bromine, methoxy or ethoxy, $X^2$ denotes nitro, cyano, alkylsulphonyl having 1 to 4 C atoms, phenylsulphonyl, dialkylphosphono having 1 to 4 C atoms in each of the alkyl radicals, bromine, chlorine or fluorine, $X^3$ denotes hydrogen, chlorine, bromine, fluorine or nitro, $X^4$ denotes nitro, cyano, alkylsulphonyl having 1 to 4 C atoms, phenylsulphonyl, trifluoromethyl, alkoxycarbonyl which has 1 to 2 C atoms in the alkoxy radical and which can also be substituted additionally by hydroxyl, chlorine or bromine, or which has 3 to 10 C atoms in the alkoxy radical and in which the carbon chain is interrupted by 1 to 3 oxygen atoms and which can be monosubstituted or polysubstituted by hydroxyl, phenoxycarbonyl which can also be substituted additionally by chlorine, bromine, nitro or methyl, aminocarbonyl, alkylaminocarbonyl which has 1 to 4 C atoms in the alkyl group and which can also be substituted additionally by hydroxyl or which has 3 to 10 C atoms in the alkyl radical which can also be interrupted by 1 to 3 oxygen atoms, dialkylaminocarbonyl having 1 to 4 C atoms in each of the alkyl radicals, each of which can also be substituted additionally by hydroxyl, or having 3 to 10 C atoms in each of the alkyl radicals, each of which can be interrupted by 1 to 3 oxygen atoms, aminosulphonyl, alkylaminosulphonyl which has 1 to 4 C atoms and which can also be sustituted additionally by hydroxyl, or alkylaminosulphonyl which has 3 to 10 C atoms and in which the carbon chain can be interrupted by 1 to 3 oxygen atoms, dialkylaminosulphonyl having 1 to 4 C atoms in each of the alkyl radicals or having 3 to 10 C atoms in each of the alkyl radicals, each of which can be interrupted by 1 to 3 oxygen atoms, alkylcarbonyl having 1 to 4 C atoms in the alkyl group, phenylcarbonyl which can also be monosubstituted or polysubstituted additionally by nitro, chlorine, bromine, methoxy or methyl, hydrogen, chlorine, bromine, fluorine, methyl or ethyl, with the proviso that not more than 3 of the radicals $X^1$ to $X^4$ represent nitro or cyano radicals, $X^5$ denotes nitro, cyano, alkylsulphonyl having 1 to 4 C atoms, phenylsulphonyl, alkoxycarbonyl having 1 to 4 C atoms in the alkoxy radical, which can also be substituted additionally by hydroxyl, methoxy or ethoxy, or phenoxycarbonyl which can also be substituted additionally by chlorine, bromine, nitro or methyl, $X^6$ denotes hydrogen, alkyl having 1 to 4 C atoms, or phenyl, $X^7$ denotes hydrogen, nitro, cyano, chlorine, bromine, alkylsulphonyl having 1 to 4 C atoms, or alkoxycarbonyl having 1 to 4 C atoms in the alkyl radical, $X^8$ denotes hydrogen, alkyl having 1 to 4 C atoms, or phenyl, and $X^9$ denotes hydrogen, bromine, chlorine, nitro, cyano, alkoxycarbonyl having 1 to 4 C atoms in the alkoxy group, alkylcarbonyl having 1 to 4 C atoms in the alkyl group, or alkylsulphonyl having 1 to 4 C atoms, with the proviso that not more than one of the radicals D, Y and $R^2$ carries an optionally substituted ethoxycarbonyl group, and if the discharge reserve printing paste which is used contains, as the discharging agent, a base which produces a pH value of at least 8 in a 5% strength aqueous solution.

Alkyl or alkoxy radicals can be straight-chain or branched, this being also the case if they are combined with other radicals. If the alkyl radical, represented by $R^1$ and/or $R^2$, which has 3 to 8 C atoms and in which the carbon chain is interrupted by 1 to 3 oxygen atoms, is polysubstituted, disubstitution is particularly suitable.

Examples of alkyl radicals having 1 to 4 C atoms in the alkylsulphonyl and dialkylphosphonyl substituents are methy, ethyl, n-propyl, n-butyl and i-butyl.

The following are examples of substituents which can be represented by Y: hydrogen, chlorine, bromine, methyl, ethyl, n-propyl, i-propyl, n-butyl, 2-butyl, i-butyl, t-butyl, methoxy, ethoxy, n-propoxy, i-propoxy, n-butoxy, i-butoxy, sec.-butoxy, β-hydroxyethoxy, β-hydroxypropoxy, γ-hydroxypropoxy, γ-hydroxybutoxy, δ-hydroxybutoxy and β,γ-dihydroxypropoxy; methoxycarbonylmethoxy, ethoxycarbonylmethoxy, methoxycarbonylethoxy and propoxycarbonylethoxy; methoxycarbonyl-β-methylethoxy; methoxycarbonyl-α-methylethoxy; methoxyethoxy, ethoxyethoxy, butoxyethoxy, 3-methoxypropoxy, 3-ethoxypropoxy, 4-methoxybutoxy, 4-propoxybutoxy, hydroxyethoxyethoxy, methoxyethoxyethoxy, ethoxyethoxyethoxy, hydroxyethoxyethoxyethoxy, ethoxyethoxyethoxy, hydroxyethoxyethoxyethoxy, ethoxyethoxyethoxyethoxy, 3-(hydroxyethoxy)l-propoxy, 3-(methoxyethoxy)-propoxy, 3-(hydroxyethoxyethoxy)-propoxy, 3-(ethoxyethoxyethoxy)-propoxy, 4-(hydroxyethoxy)-butoxy, 4-(ethoxyethoxy)-butoxy, 4-(hydroxyethoxyethoxy)-butoxy, 2,3-dihydroxypropoxyethoxy, 2-hydroxy-3-methoxy-propoxy, 2-hydroxy-3S-propoxy-propoxy, cyanoethoxy and acetoxyethoxy.

The following are examples of substituents which can be represented by R: methyl, ethyl, n-propyl, i-propyl, n-butyl, i-butyl, chloromethyl, 2-chloroethyl, 4-chlorobutyl, bromomethyl, 2-bromomethyl-3-bromopropyl, hydroxymethyl, 2-hydroxyethyl, 4-hydroxybutyl, acetoxymethyl, methoxymethyl, methoxyethyl, ethoxymethyl, ethoxyethyl, 4-methoxybutyl, 4-ethoxybutyl, 2-acetoxyethyl, 4-acetoxybutyl, 4-propionyloxybutyl, 4-chlorophenyl, 2,5-dichlorophenyl, 2-nitrophenyl, 3-nitrophenyl, 2-chloro-5-nitrophenyl, 3-nitro-4-chlorophenyl, 4-chloro-3,5-dinitrophenyl, 2-methylphenyl, 2-methyl-5-chlorophenyl, 2-methyl-5-nitrophenyl, 4-methylphenyl, 3-chloro-4-methylphenyl, 3-nitro-4-methylphenyl, 3,5-dinitro-4-methylphenyl, 2-methyl-3,5-dinitrophenyl, 2,5-dimethylphenyl, 2,4-dimethyl-3-chlorophenyl, 2,4-dimethyl-3,5-dichlorophenyl, 2,4-3-chlorophenyl, 2,4-dimethyl-3,5-dichlorophenyl, 2,4-dimethyl-3-nitro-5-chlorophenyl, 2,4,6-trimethylphenyl, 2,5-dimethyl-4-chlorophenyl and 2,4-dimethyl-3,5,6-trichlorophenyl.

The following are examples of alkyl radicals which can be represented by $R^1$ and/or $R^2$: methyl, ethyl, n-propyl, i-propyl, n-butyl, i-butyl, sec.-butyl, 2-chloroethyl, 2-bromoethyl, 2-cyanoethyl, 2-chloropropyl, 2-bromopropyl, 2-cyanopropyl, 3-chloropropyl, 3-bromopropyl, 3-cyanoproyl, 2-, 3- or 4-chlorobutyl, 2-, 3- or 4-bromobutyl, 2-, 3- or 4-cyanobutyl, 2,3-dihydroxypropyl, 2-hydroxy-3-chloropropyl, 2-acetoxyethyl, 2-propionyloxyethyl, 2-butyryloxyethyl, 2-acetoxypropyl, 2-propionyloxypropyl, 2-butyryloxypropyl, 3-acetoxypropyl, 3-propionyloxypropyl, 3-butyryloxypropyl, 3-acetoxybutyl, 3-propionyloxybutyl, 3-butyryloxybutyl, 4-acetoxybutyl, 4-propionyloxybutyl, 4-butyryloxybutyl, 2-phenoxyacetoxyethyl, 3-phenoxyacetoxypropyl, 4-phenoxyacetoxybutyl, methylaminocarbonyloxyethyl, ethylaminocarbonyloxyethyl, propylaminocarbonyloxyethyl, butylaminocarbonyloxyethyl, methylaminocarbonyloxyprop-3-yl, ethylaminocarbonyloxyprop-3-yl, propylaminocarbonyloxyprop-3-yl, butylaminocarbonyloxyprop-3-yl, methylaminocarbonyloxybut-4-yl, ethylaminocarbonyloxybut-4-yl, propylaminocarbonyloxybut-4-yl or butylaminocarbonyloxybut-4-yl; 2-hydroxyethyl, 2-hydroxypropyl, 3-hydroxypropyl, 1-hydroxyprop-2-yl, 2-, 3- or 4-hydroxybutyl or 1-, 3- or 4-hydroxybut-2-yl; methoxyethyl, methoxyprop-3-yl, methoxybut-4-yl, methoxybut-3-yl, methoxybut-2-yl, ethoxyethyl, ethoxyprop-3-yl, ethoxybut-4-yl, ethoxybut-3-yl, ethoxybut-2-yl, propoxyethyl, propoxyprop-3-yl, propoxybut-4-yl, propoxybut-3-yl, propoxybut-2-yl or butoxyethyl, butoxyprop-3-yl, butoxybut-4-yl, butoxybut-3-yl or butoxybut-2-yl; hydroxyethoxyethyl, hydroxyethoxyprop-3-yl, hydroxyethoxybut-4-yl, hydroxyethoxybut-3-yl, hydroxyethoxybut-2-yl, methoxyethoxyethyl, methoxyethoxyprop-3-yl, methoxyethoxybut-4-yl, methoxyethoxybut-3-yl, methoxyethoxybut-2-yl, propoxyethoxyethyl, propoxyethoxyprop-3-yl, propoxyethoxybut-4-yl, propoxyethoxybut-3-yl, propoxyethoxybut-2-yl or butoxyethoxyethyl, butoxyethoxyprop-3-yl, butoxyethoxybut-4-yl, butoxyethoxybut-3-yl or butoxyethoxybut-2-yl, hydroxyethoxyethoxyethyl, methoxyethoxyethoxyethyl, propoxyethoxyethoxyethyl or butoxyethoxyethoxyethyl or ethoxyethoxyethoxybut-4-yl or ethoxyethoxyethoxybut-2-yl; 2,3-dihydroxypropoxyethyl,2,3-dihydroxypropoxyprop-3-yl, 2,3-dihydroxypropoxybut-4-yl, 2,3-dihydroxypropoxybut-3-yl or 2,3-dihydroxypropoxybut-2-yl; 2-hydroxy-3-chloropropoxyethyl; 2-hydroxy-3-methoxypropyl, 2-hydroxy-3-ethoxypropyl, 2-hydroxy-3-butoxypropyl, 2-hydroxy-3-methoxyethoxypropyl, 2-hydroxy-3-ethoxyethoxypropyl, 2-hydroxy-3-(3-methoxypropoxy)-propyl, 2-hydroxy-3-(4-ethoxybutoxy)-propyl, benzyl, phenethyl, phenoxyethyl, phenoxyprop-3-yl, phenoxybut-4-yl, phenoxybut-3-yl or phenoxybut-2-yl.

The following can additionally be represented by $R^2$: phenyl, methoxycarbonylethyl, methoxycarbonyl-1-methylethyl, methoxycarbonyl-2-methylethyl, ethoxycarbonylethyl, ethoxycarbonyl-1-methylethyl, ethoxycarbonyl-2-methylethyl, hydroxyethoxycarbonylethyl, hydroxyethoxycarbonyl-1-methylethyl, hydroxyethoxycarbonyl-2-methylethyl, chloroethoxycarbonylethyl, chloroethoxycarbonyl-1-methylethyl, chloroethoxycarbonyl-2-methylethyl, methoxyethoxycarbonylethyl, methoxyethoxycarbonyl-1-methylethyl or methoxyethoxycarbonyl-2-methylethyl, allyl, methallyl, crotyl, cyclohexyl or cyclopentyl.

Bases which are present as discharging agents in the discharge reserve printing paste and which produce a pH value of at least 8 in a 5% strength aqueous solution, are known in large numbers. Examples of such bases are the hydroxides of the alkali metals and alkaline earth metals, salts of alkaline earth and alkali metals with weak organic or inorganic acids, such as, for example, alkali metal acetates, carbonates or bicarbonates, tri-alkali metal phosphates, ammonia or aliphatic amines, such as, for example, triethylamine, tripropylamine, tributylamine, ethanolamine, dimethylethanolamine, diethylethanolamine, diethanolamine, methyl diethanolamine, ethyl diethanolamine, propyl diethanolamine or triethanolamine. The bases usually employed are alkaline earth metal hydroxides, such as, for example, calcium hydroxide, alkali metal hydroxides, such as, for example, sodium hydroxide or potassium hydroxide, or alkali metal salts of weak inorganic acids, such as, for example, sodium carbonate or trisodium phosphate. The base which is preferably used in the discharge reserve printing pastes is sodium hydroxide or potassium hydroxide or, in particular, sodium carbonate or bicarbonate or potassium carbonate or bicarbonate. Mixtures of different bases can also be used. The concentration of the base in the discharge reserve printing pastes is advantageously 25 to 250 g/kg, preferable 50 to 130 g/kg. Besides the said bases, the discharge reserve printing pastes contain the customary additives present in textile printing pastes, in particular thickeners, such as, for example, alginates, starch products or synthetic polymeric thickeners, mineral oils, hydrotropic substances, such as, for example, urea, and additives which promote wetting, penetration and absorption of dyestuff. The presence of nonionic detergents, which are appropriately contained in the discharge reserve printing pastes, such as, for example, glycerol and/or polyglycols, such as polyethylene glycol having an average molecular weight of 300 to 400, is particularly favourable for the discharging process.

Dyestuffs of the formula I which are preferred for use by the process according to the invention are those in which the radicals $R^1$ and/or $R^2$ carry one or more, for example, two, hydroxyl groups. In this connection the following radicals are particularly preferred: 2-hydroxyethyl, 2,3-dihydroxypropyl, 2-hydroxy-3-chloropropyl, 2-hydroxy-3-alkoxypropyl having 1 to 4 C atoms in the alkoxy group, such as, for example, 2-hydroxy-3-methoxypropyl or 2-hydroxy-3-ethoxypropyl, or 2-hydroxy-3-alkoxypropyl having 3 to 8 C atoms in the alkoxy group, which is interrupted by 1 to 3 oxygen atoms, such as, for example, 2-hydroxy-3-methoxyethoxypropyl and 2-hydroxy-3-ethoxyethoxypropyl.

Alkyl radicals which are interrupted by oxygen and have the formula $$[CH_2CH_2O]_m(CH_2)_nH,$$

in which m can assume the values 1 to 4 and n can assume the values 0 to 4, are also preferred for $R^1$ and/or $R^2$.

Further examples of preferred radicals for $R^2$ are alkoxycarbonylethyl radicals, in particular methoxycarbonylethyl, ethoxycarbonylethyl, hydroxyethoxycarbonylethyl or 2-chloroethoxycarbonylethyl.

Examples of radicals which are preferred for R are methyl, ethyl, hydroxymethyl, 2-hydroxyethyl, methoxymethyl, methoxyethyl, ethoxymethyl, ethoxyethyl, methoxyethoxymethyl, ethoxyethoxymethyl, phenyl, chlorophenyl, nitrophenyl and dichlorophenyl.

Preferred radicals for Y are hydrogen, methyl, methoxy, ethoxy, hydroxyethoxy, methoxyethoxy, ethoxyethoxy, hydroxyethoxyethoxy, methoxyethoxyethoxy, 2,3-dihydroxypropoxy, methoxycarbonylmethoxy, methoxycarbonylethoxy and ethoxycarbonylethoxy.

It is also preferable to employ dyestuffs of the formula I wherein D denotes a radical of the formula II and $X^4$ denotes nitro, cyano, methylsulphonyl, ethylsulphonyl, methoxycarbonyl, ethoxycarbonyl, alkoxycarbonyl which has 3 to 8 C atoms in the alkoxy radical and in which the carbon chain is interrupted by 1 to 3 oxygen atoms and can be monosubstituted or polysubstituted by hydroxyl, aminosulphonyl, alkylaminosulphonyl which has 1 to 4 C atoms and which can also be substituted additionally by hydroxyl, or alkylaminosulphonyl which has 3 to 8 C atoms and in which the carbon chain can be interrupted by 1 to 3 oxygen atoms, acetyl, propionyl, trifluoromethyl, fluorine, chlorine, bromine, methyl or hydrogen and/or $X^1$ and/or $X^2$ denotes nitro, methylsulphonyl, ethylsulphonyl or cyano and/or $X^1$ denotes methoxycarbonyl or ethoxycarbonyl and/or $X^3$ denotes hydrogen, chlorine or nitro.

Dyestuffs of the formula II which are particularly preferred are those containing combinations of preferred substituents $X^1$, $X^2$, $X^3$ and $X^4$ mentioned above.

Dyestuffs of the formula I which are very particularly preferred are those wherein D denotes a radical of the formula II in which $X^1$, $X^2$, $X^3$, $X^4$, Y, R, $R^1$ and $R^2$ form a combination of the radicals preferred for $X^1$, $X^2$, $X^3$, $X^4$, Y, $R^1$ and $R^2$.

Preferred dyestuffs of the formula I in which D denotes a radical of the formula III, are those in which $X^5$ represents nitro, cyano or alkylsulphonyl having 1 or 2 C atoms and $X^6$ represents hydrogen or methyl.

Dyestuffs which are particularly preferred in this connection are those in which $X^5$ represents nitro and $X^6$ represents hydrogen. Dyestuffs of the formula I wherein D denotes a radical of the formula III which are very particularly preferred are those in which radicals preferred for $X^5$ and $X^6$ are combined with radicals preferred for Y, R, $R^1$ and $R^2$.

Preferred dyestuffs of the formula I wherein D denotes a radical of the formula IV are those in which $X^7$ denotes nitro, cyano and alkylsulphonyl having 1 or 2 C atoms or alkoxycarbonyl having 1 or 2 C atoms in the alkoxy group, $X^8$ denotes hydrogen and $X^9$ denotes nitro, cyano or alkylsulphonyl having 1 or 2 C atoms.

Dyestuffs which are particularly preferred in this connection are those in which $X^7$ and $X^9$ are present in the combinations nitro/nitro; nitro/cyano; nitro/methoxycarbonyl or nitro/ethoxycarbonyl.

Dyestuffs of the formula I which are particularly preferred are those in which D denotes a radical of the formula V or VI.

Dyestuffs of the formula I which are very particularly preferred are those which contain a particularly preferred radical D of the formula III, IV, V or VI in conjunction with radicals preferred for R, Y, $R^1$ and $R^2$.

From a technical point of view, mixtures of appropriate dyestuffs of the formula I are particularly advantageous in regard to dyestuff yield, affinity and fastness of dyeings or prints. Such dyestuff mixtures contain 10 to 90, preferably 30 to 70, % by weight of a dyestuff of the formula I and 90 to 10, preferably 30 to 70, % by weight of a second dyestuff of the formula I. Such dyestuff mixtures can be prepared by mixing the individual dyestuffs or, in accordance with the method described later in the text, by diazotisation and coupling with a mixture of different coupling components.

The process according to the invention is preferentially suitable for textile materials consisting of water-repellent fibres, in particular polyester fibres. However, it is also suitable for textile materials containing water-repellent fibres to a predominant extent together with other fibres, such as, for example, staple rayon or cotton.

The disperse dyestuffs of the formula I which can be discharged to white can be applied to the textile material in the form of dye liquors or printing pastes. This is effected by impregnating the textile material with the dye liquor in a manner which is in itself known, for example padding or slop-padding. The dye liquors can contain one or more disperse dyestuffs of the formula I in addition to the known, customary dyeing auxiliaries, such as, for example, dispersing agents, wetting agents, anti-foam agents and padding auxiliaries. The impregnated fabric web is squeezed out to a liquor pick-up of 50 to 120%. The fabric webs are then dried by warm air, if necessary preceded by infrared irradiation, the temperature being approx. 80° C. or a maximum of, say, 90° C., with a corresponding shortening of the time. The fabric webs which have been pre-treated in this way are then printed with a discharge reserve printing paste containing, as the discharging agent, one of the bases described in greater detail above and also the known additives, in particular thickeners, which are customary in printing pastes for textile printing. The impregnated and printed fabric webs are then subjected to a heat treatment at a temperature between 100° and 230° C. Within the lower temperature range from about 100° to 110° C., the supply of heat is preferably effected by means of superheated steam. For heat treatments carried out at temperatures between 160° and 230° C., hot air is preferably used as the heat transfer agent. After the heat treatment, which results in fixation of the disperse dyestuffs of the formula I on the areas not after-printed with discharge reserve printing paste, and in the destruction of the disperse dyestuffs of the formula I on the areas printed with discharge reserve printing paste, the textiles are subjected to after-treatment in the manner customary for polyester, are given a hot and cold rinse and are dried.

A particular embodiment of the process according to the invention consists in the dye liquor containing, not only disperse dyestuffs of the formula I, but also one or more disperse dyestuffs which are resistant to alkali and are thos not destroyed by the alkaline discharge reserve printing pastes to be employed in accordance with the invention. If the procedure followed is in other respects as indicated above, multi-coloured designs are obtained.

As already mentioned, it is also possible to print the disperse dyestuffs of the formula I onto the fabric in the form of printing pastes and then to after-print the fabric with the discharge reserve printing paste. The textile prints are then subsequently fixed and finished as already described above. In this process too, it is possible to add one or more alkali-resistant disperse dyestuffs to the dye printing paste printed on initially, which can also contain several disperse dyestuffs of the formula I. In this case too, multi-coloured designs are obtained. A further possible means of carrying out the process according to the invention consists in printing discharge reserve printing pastes which can, in turn, contain alkali-resistant disperse dyestuffs, onto the ground which has been impregnated or printed with disperse dyestuffs of the formula I. Here too, multi-coloured designs are obtained when the textile materials are subsequently fixed and finished as described above.

Discharge reserve prints can be applied by the process according to the invention not only onto textile materials which consist of water-repellent fibres, in particular polyester fibres or which mainly contain such fibres, but also onto textile materials containing water-repellent fibres, in particular polyester fibres, and cellulose fibres in comparable ratios. Polyester/cellulose mixed fabrics of this type can have, for example, a polyester/cellulose ratio by weight of 75:25, 65:35 or 50:50. It is possible to apply discharge reserve prints onto mixed fabrics of this type by the process according to the invention if the dye liquor or printing paste, which contains at least one disperse dyestuff of the formula I which is dischargeable to white and, if appropriate, also one or more disperse dyestuffs which are resistant to discharging agents, also contains, in addition, at least one dischargeable reactive dyestuff containing a reactive radical of the formula $$-SO_2-CH_2-CH_2-Hal \quad \text{(VII) or}$$

$$-SO_2-CH_2-CH_2-O-SO_3X \quad \text{(VIII) or}$$

$$-NH-SO_2-CH_2-CH_2-OSO_3X \quad \text{(IX) or}$$

$$-SO_2-CH=CH_2 \quad \text{(X)}$$

wherein X denotes hydrogen or a metal cation, in particular the sodium cation, and Hal denotes halogen, in particular chlorine or bromine, and contains, if appropriate, one or more reactive dyestuffs which are resistant to discharging, and if the discharge reserve printing paste contains, in addition to an alkali metal carbonate or bicarbonate, an alkali metal sulphite or bisulphite and, if appropriate, an aldehyde, and if the process is carried out in other respects as already indicated.

The dischargeable reactive dyestuffs to be employed contain one of the fibre-reactive radicals of the formulae II to X indicated above. It is common to the radicals of the formulae VII to IX that they form a vinylsulphonyl group in the presence of alkali, with the liberation of a sulphate or halide anion. This group which has been formed in the presence of alkali becomes fixed on cotton or staple rayon by addition of an OH group of the cellulose to the vinyl double bond, in the same manner as the vinylsulphonyl radical of the formula X which is directly linked to the dyestuff radical. Dischargeable reactive dyestuffs containing one of the reactive radicals mentioned above can belong to any industrially important group of dyestuffs. The monoazo dyestuffs C.I. Yellow 13 to 17 and 72 to 74, Orange 7, 15, 16, 23, 24 and 55, Red 21 to 23, 35, 36, 50, 63, 103 to 107 and 112 to 114, Blue 28 and Brown 16; the disazo dyestuffs C.I. Blue 76, Blue 98 and Black 5 and 31; the monoazo and disazo metal complex dyestuffs C.I. Violet 4 and 5, Blue 20 and Brown 18; the anthraquinone dyestuffs C.I. Violet 22 and Blue 19 and 27; and the phthalocyanine dyestuffs C.I. Blue 21, 38, 77 and 91 and Green 14 are mentioned as examples of suitable reactive dyestuffs. Dischargeable reactive dyestuffs which are particularly preferred are those which contain, as the reactive anchor, at least one fibre-reactive radical of the formula VIII or IX.

The quantities of disperse and reactive dyestuffs which are present in the padding liquors or printing pastes when treating mixed fabrics are, as usual, adjusted to suit the depth of colour of the desired dyeing and the intensity of the reactive effect. Additionally, the quantity of the dyestuffs suitable for one of the types of fibre involved also depends on the ratio of this type of fibre to the whole fibre mixture. Thus, for example, if the mixed fabric contains mainly cellulose fibres, a padding liquor which is prepared for a ground dyeing of a specific colour shade will contain a high proportion of dischargeable and, if appropriate, non-dischargeable reactive dyestuffs and a low proportion of dischargeable and, if appropriate, non-dischargeable disperse dyestuffs, and, if the substrate contains mainly polyester fibres, the padding liquor will contain a high proportion of disperse dyestuffs or only disperse dyestuffs and a low proportion of reactive dyestuffs or none at all.

If, when carrying out the process according to the invention, the padding liquor or printing paste, in addition to one or more dischargeable disperse dyestuffs of the formula I, also contains one or more dischargeable reactive dyestuffs containing reactive radicals of the formulae VII to X, the discharge reserve printing paste used will be a paste which, in addition to an alkali metal carbonate or bicarbonate, also contains an alkali metal sulphite or bisulphite as the reserving agent for the reactive dyestuffs. The alkali metal bisulphite can also be completely or partially replaced by an equivalent quantity of an alkali metal bisulphite aldehyde adduct. It is also possible to produce this adduct in the reserve paste itself, by adding to the reserve paste an alkali metal bisulphite, an alkali metal bicarbonate and an aldehyde. Alkali metal sulphites, bisulphites and bicarbonates which are suitable for use in industry are, in particular, the sodium or potassium salts, preferably the sodium salts. Possible aldehydes which can be present in the reserve pastes in the form of alkali metal bisulphite adducts are, in principle, any aldehyde which is readily accessible on an industrial scale, such as, for example, formaldehyde, acetaldehyde, glyoxal or benzaldehyde. Since the aldehyde/alkali metal bisulphite adducts are in equilibrium with the individual components of the adduct, preferred aldehydes are those which do not have an excessively high vapour pressure in the free state and which thus do not give rise to odour nuisance. Glyoxal, for example, is particularly suitable for use in accordance with the invention.

When preparing printing pastes containing sodium bisulphite in combination with an aldehyde, the use of separately prepared addition compounds of these two components offers particular advantages. Thus, for example, the use of such an adduct makes it possible to avoid the troublesome foaming which can occur in unfavourable cases when preparing printing pastes containing an alkali metal bicarbonate. The concentration of the total of the reserving agents in the printing pastes is appropriately 25 to 250 g/kg, preferably 50 to 130 g/kg.

Apart from the different composition of the padding liquor or printing paste and of the discharge reserve printing paste, the process stages when producing discharge reserve prints on polyester/cellulose mixed fabrics are the same as those in the treatment of fabrics consisting of polyester or containing mainly polyester. However, when producing discharge reserve prints on polyester/cellulose mixed fabrics by padding or printing the fabric, drying or incipiently drying and subsequently after-printing with the discharge reserve printing paste, it is appropriate to subject the padded and printed textile sheet-like structure to a heat treatment at temperatures between 100° and 190° C. and, in so doing, to supply the heat required preferably by means of superheated steam. The effect of the heat treatment is (a), on the areas printed with a discharge reserve printing paste, to inhibit the dischargeable disperse and reactive dyestuffs and to fix any nonreservable disperse and reactive dyestuffs which may be present, and (b), on the areas which have not been printed with discharge reserve printing paste, to fix the disperse dyestuffs and, if the padding liquor or printing paste contained an alkali metal formate, also to fix the reactive dyestuffs at the same time. In this connection, inhibition of the dyestuff is to be understood as meaning the change in the dyestuff molecule caused by the reserving agent, which has the effect that the dyestuff concerned no longer dyes the substrate. In the two-phase process, that is if the padding liquor or printing paste did not contain an alkali metal formate, the reactive dyestuffs in the ground dyeing, that is to say on the areas which have not been printed with discharge reserve printing paste, are subsequently fixed in a manner which is in itself known. Finally, the dyeings or prints on the mixed fabrics are subjected to a hot and cold rinse and are dried.

A particular embodiment of the process according to the invention on mixed fabrics consists in the padding liquor or printing paste containing, in addition to dischargeable disperse and reactive dyestuffs, disperse and reactive dyestuffs which are resistant to discharging and which are thus not destroyed by the discharge reserve printing pastes to be employed in accordance with the invention. If the procedure followed is in other respects as indicated above, multi-coloured designs are obtained. A further possible means of carrying out the process according to the invention in the case of mixed fabrics consists in printing, onto the ground which has been padded or printed with reservable dyestuffs, discharge reserve printing pastes which, in turn, contain disperse and reactive dyestuffs which are resistant to the reserving agent. Here too, multi-coloured designs are obtained when the textile materials are subsequently fixed and finished as described above.

It is preferable to apply the disperse dyestuffs of the formula I, which can be discharged to white, to the fabric by impregnation using a padding liquor.

The disperse dyestuffs of the formula I are present in the padding liquors or in the printing pastes in a finely dispersed form, such as is customary and known for disperse dyestuffs, while the reactive dyestuffs which may be present are dissolved. The preparation of the padding liquors or printing pastes which are to be employed in the process according to the invention is also effected in a manner which is in itself known by mixing the constituents of the liquors or printing pastes with the required quantity of water and liquid, finely disperse or solid, redipersible formulations of the disperse dyestuffs or solutions or formulations of the reactive dyestuffs.

Alkali-resistant disperse dyestuffs which can combined with the dyestuff of the formula I for the production of multi-coloured designs are the known commercial dyestuffs belonging to the group comprising the azo, azomethane, quinophthalone, nitro or anthraquinone dyestuffs. The following are a few examples of alkali-resistant disperse dyestuffs:

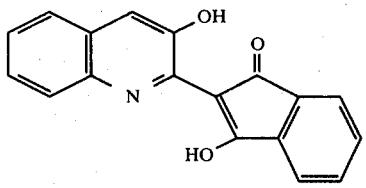

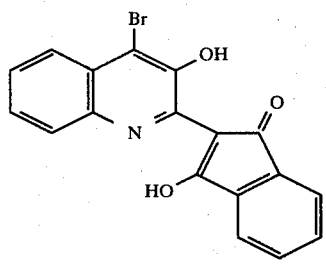

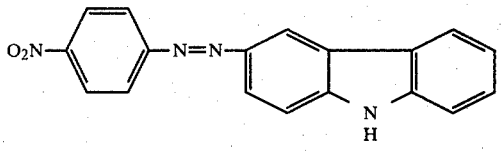

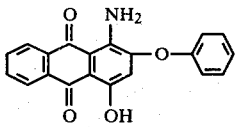

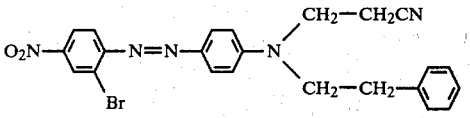

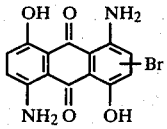

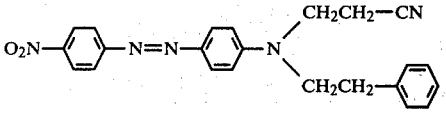

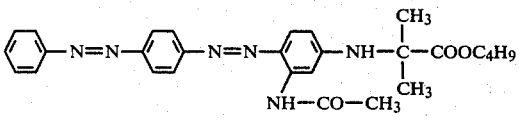

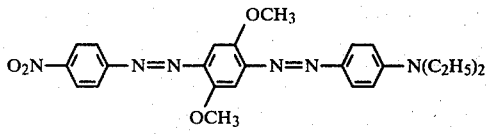

Reactive dyestuffs which are resistant to the reserving agent and which can be combined with the dischargeable reactive dyestuffs in order to produce multicoloured designs on polyester/cellulose mixed fabrics are the known commercial dyestuffs belonging to the group comprising the azo, azomethine, quinophthalone, nitro or anthraquinone dyestuffs, which contain, as the fibre-reactive radical, a radical belonging to the class of the triazines, quinoxalines, phthalazines, pyridazines, pyrimidines or $\alpha,\beta$-unsaturated aliphatic carboxylic acids. The following text mentions, as representatives of the whole class, the most important compounds from which are derived the fibre-reactive radicals of the reactive dyestuffs which are resistant to the reserving agent: cyanuric chloride, cyanuric bromide, cyanuric fluoride, dihalogenomonoaminotriazines, such as 2,6-dichloro-4-aminotriazine, 2,6-dichloro-4-methylaminotriazine, 2,6-dichloro-4-oxethylaminotriazine, 2,6-dichloro-4-phenylaminotriazine and 2,6-dichloro-4-(o-, m- or p-sulphophenyl)-aminotriazine, dihalogenoalkoxy-sym.-triazines and dihalogenoaryloxy-sym.-triazines, tetrahalogenopyrimidines, 2,4,6-trihalogenopyrimidines, derivatives of heterocyclic carboxylic or sulphonic acids, such as 3,6-dichloropyridazine-4-carboxylic acid chloride, 2,4-dichloropyrimidine-5-carboxylic acid chloride, 2,4,6-trichloropyrimidine-5-carboxylic acid chloride, 4,5-dichloro-6-pyridazonylpropionyl chloride, 1,4-dichlorophthalazine-6-carboxylic acid chloride, 5,6-dichloro-4-methyl-2-methylsulphonylpyrimidine, 2-monochloroquinoxaline-6-carboxylic acid chloride, 2-monochloroquinoxaline-6-sulphonyl chloride, 3-monochloroquinoxaline-6-carboxylic acid chloride or 3-monochloroquinoxaline-6-sulphonyl chloride, 2,3-dichloroquinoxaline-6-carboxylic acid chloride or 2,3-dichloroquinoxaline-6-sulphonyl chloride, 1,4-dichlorophthalazine-6-carboxylic acid chloride or 1,4-dichlorophthalazine-6-sulphonyl chloride, 2,4-dichloroquinazoline-6-carboxylic acid chloride, 2,4-dichloroquinazoline-6-sulphonyl chloride, 2,4-dichloroquinazoline-7-carboxylic acid chloride or 2,4-dichloroquinazoline-7-sulphonyl chloride, 2-chlorobenzthiazole-5-carboxylic acid chloride, 2-chlorobenzthiazole-6-carboxylic acid chloride, 2-chlorobenzthiazole-5-sulphonyl chloride or 2-chlorobenzthiazole-6-sulphonyl chloride, 2-methylsulphonylbenzthiazole-5-sulphonyl chloride, 2-methylsulphonylbenzthiazole-6-sulphonyl chloride, 2-ethylsulphonylbenzthiazole-5-sulphonyl chloride, 2-ethylsulphonylbenzthiazole-6-sulphonyl chloride, 2-phenylsulphonylbenzthiazole-5-sulphonyl chloride or 2-phenylsulphonylbenzthiazole-6-sulphonyl chloride, acrylol chloride and 3-chloropropionyl chloride.

The greater part of the disperse dyestuffs of the formula I to be employed in accordance with the invention are known and are described, for example, in French Patent Specification Nos. 1,167,704, 1,350,486, 810,412, 829,010, 1,428,383, 2,018,473 and 2,008,404, Belgian Patent Specification Nos. 668,126, 668,829, 687,324, 6,954,420, 716,534 and 777,571, British Patent Specification Nos. 852,493, 872,204, 865,409 and 1,319,964, Japanese Patent Specification Nos. 43,981/66, 7,221,628, 7,312,044, 4,901,866, 4,900,320 and 4,937,931, Swiss Patent Specification No. 343,560, South African Patent Specification No. 6,907,109 and German Offenlegungsschriften Nos. 1,295,115, 1,810,063, 1,835,482, 1,946,543, 2,107,668, 2,120,876, 2,120,877, 2,318,294, 2,329,133, 2,234,465, 2,361,487, 2,402,544 and 2,412,751.

Insofar as the dyestuffs are not mentioned in the said publications, they can, nevertheless, be prepared in full analogy with the preparation processes described in those publications, by diazotising an amine of the formula $$D-NH_2$$

and coupling the product with a coupling component or a mixture of several coupling components of the formula XI

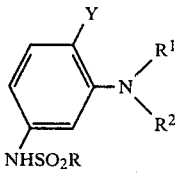

(XI)

wherein D, Y, R, $R^1$ and $R^2$ have the meanings indicated above. The diazotisation of the amine of the formula $D—NH_2$ is effected, for example, by the action of nitrous acid or compounds which split off nitrous acid. For example, the amines $D—NH_2$ can be dissolved in sulphuric acid, hydrochloric acid or lower aliphatic carboxylic acids, such as, for example, acetic acid or propionic acid, and can be diazotised at 0° to 60° by adding nitrosyl sulphuric acid or sodium nitrite. The coupling of the diazotised amine X with the amine XI is carried out at temperatures from 0° to 30° in an acid aqueous medium or in a lower aliphatic carboxylic acid, such as, for example, acetic acid, which is appropriately diluted with water, or in a mixture of water and an alcohol which is sparingly soluble in water, such as n-butanol or i-butanol. In this connection, the temperature range from 0° to 20° C. is preferred. In order to complete the coupling reaction, it can be appropriate to buffer the pH value of the coupling batch to a value from 3 to 6 towards the end of the reaction, by adding alkalis, such as, for example, sodium acetate. The dyestuff is then isolated in a customary manner.

Dyestuffs of the formula I wherein D denotes a radical of the formula II and which carry cyano, nitro, alkylsulphonyl, arylsulphonyl or dialkylphosphono groups in the o-position in the diazo components, are appropriately prepared by replacing Hal in the dyestuffs of the formula XII

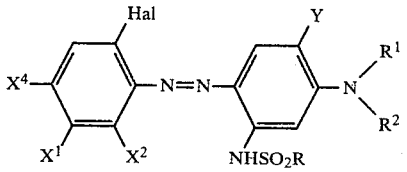

(XII)

wherein Hal represents fluorine, chlorine, bromine or iodine, by cyano, nitro, alkylsulphonyl, arylsulphonyl or diethylphosphono. Processes for effecting this are described, for example, in German Offenlegungsschriften Nos. 1,280,915, 1,807,642 and 1,809,921 or J. Chem. Soc. Perkin I, 1979, page 2634 or German Offenlegungsschrift No. 2,846,438. Methylsulphonyl or arylsulphonyl groups can also be introduced, as described in German Offenlegungsschrift 1,809,921, by replacing the nitro groups in the o-position in dyestuffs of the formula XIII

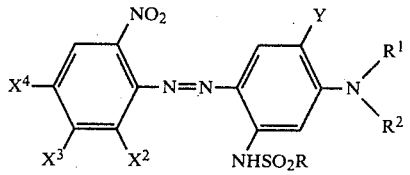

(XIII)

In the examples which follow, unless otherwise specified, parts are parts by weight and percentages are percentages by weight.

EXAMPLE 1

20 parts of the mixture of dyestuffs of the formula

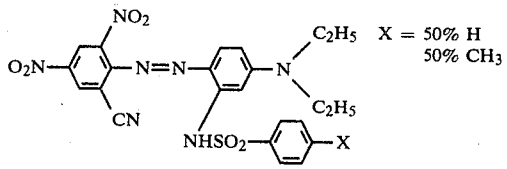

are added, in a fine state of division, to a padding liquor containing, per 1,000 parts, 937 parts of water, 3 parts of monosodium phosphate, 10 parts of sodium chlorate and 20 parts of a polymerisation product based on acrylic acid, as an anti-migration agent. After drying, the goods are after-printed with a printing paste containing, per 1,000 parts, 600 parts of an aqueous 10% strength locust bean flour ether thickener, 120 parts of water, 80 parts of sodium carbonate, 100 parts of polyethylene glycol 400 and 100 parts of glycerol. After fixing using superheated steam for 7 minutes at 175° C., reductive after-treatment, soaping, subsequent rinsing and drying, a blue print which has very good fastness properties, above all good fastness to light, fixing by dry heat, rubbing and washing, is obtained. A very good white ground with sharp outlines is obtained on the areas on which the printing paste containing sodium carbonate has been printed.

EXAMPLE 2

20 parts of the dyestuff of the formula

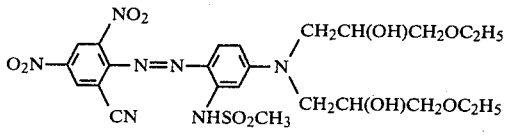

are used instead of 20 parts of the dyestuff of Example 1 and the procedure followed is in other respects as indicated in Example 1. This gives a blue print which has very good tinctorial properties, in particular good fastness to light, fixing by dry heat, rubbing and washing, and which has a very good white ground with sharp outlines on the discharged areas.

EXAMPLE 3

20 parts of the dyestuff of the formula

TABLE I

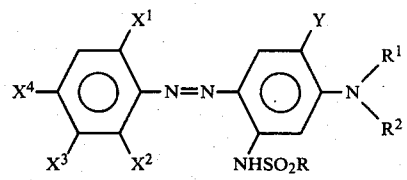

| $X^1$ | $X^2$ | $X^3$ | $X^4$ | Y | R | $R^1$ | $R^2$ | Shade |
|---|---|---|---|---|---|---|---|---|
| $NO_2$ | CN | H | $NO_2$ | H | $CH_3$ | $[(CH_2)_2O]_2C_2H_5$ | $[(CH_2)_2O]_2C_2H_5$ | 1 |
| $NO_2$ | CN | H | $NO_2$ | H | $CH_3$ | $CH_2CH(OH)CH_2OCH_3$ | $CH_2CH(OH)CH_2OCH_3$ | 1 |
| $NO_2$ | CN | H | $NO_2$ | H | $CH_3$ | $CH_2CH(OH)CH_2OH$ | $CH_2CH(OH)CH_2OH$ | 1 |
| $NO_2$ | CN | H | $NO_2$ | $O(CH_2)_2OCH_3$ | $CH_3$ | $CH_2CH(OH)CH_2OH$ | $(CH_2)_2COOCH_3$ | 1 |
| $NO_2$ | CN | H | $NO_2$ | H | $CH_3$ | $C_2H_5$ | $(CH_2)_2OH$ | 1 |
| $NO_2$ | CN | H | CN | H | $CH_2OH$ | $CH_2CH(OH)CH_2Cl$ | $(CH_2)_2OH$ | 1 |
| CN | CN | H | $NO_2$ | H | $CH_2OC_2H_5$ | $(CH_2)_2OH$ | $(CH_2)_2OCOCH_3$ | 1 |
| $NO_2$ | CN | H | $NO_2$ | H | $CH_2O(CH_2)_2OCH_3$ | $C_2H_5$ | $C_2H_5$ | 1 |
| $NO_2$ | CN | H | $NO_2$ | H | $CH_2O(CH_2)_2OC_2H_5$ | $(CH_2)_2CN$ | $(CH_2)_2OH$ | 1 |
| $NO_2$ | CN | H | $NO_2$ | H | $(CH_2)_2OH$ | $CH_2CH(OH)CH_2OC_2H_5$ | $CH_2CH(OH)CH_2OC_2H_5$ | 1 |
| CN | CN | H | $NO_2$ | Cl | $CH_2OH$ | $[(CH_2)_2O]_2H$ | $[(CH_2)_2O]_2H$ | 1 |
| $NO_2$ | CN | H | $NO_2$ | $CH_3$ | $CH_3$ | $CH_2CH(OH)CH_2Cl$ | $(CH_2)_2COOC_2H_5$ | 1 |
| CN | CN | H | $NO_2$ | $CH_3$ | $C_6H_5$ | $CH_2CH(OH)CH_2O(CH_2)_2OCH_3$ | $CH_2CH(OH)CH_2O(CH_2)_2OCH_3$ | 1 |
| $NO_2$ | CN | H | $NO_2$ | $O(CH_2)_2OCH_3$ | $CH_3$ | $CH_2CH(OH)CH_2OH$ | H | 1 |
| $NO_2$ | CN | H | $NO_2$ | $O(CH_2)_2OCH_3$ | $CH_2O(CH_2)_2OCH_3$ | $(CH_2)_2OH$ | H | 1 |
| $NO_2$ | CN | H | $NO_2$ | $OCH_3$ | $C_6H_4$—4-$CH_3$ | $[(CH_2)_2O]_2C_2H_5$ | H | 1 |
| $NO_2$ | $NO_2$ | H | CN | $OC_2H_5$ | $CH_3$ | $[(CH_2)_2O]_3H$ | $[(CH_2)_2O]_3H$ | 1 |
| $NO_2$ | CN | H | $NO_2$ | H | $C_6H_5$ | $CH_2CH(OH)CH_2Cl$ | $(CH_2)_2OH$ | 1 |
| $NO_2$ | CN | H | CN | H | $C_6H_5$ | $CH_2CH(OH)CH_2OC_6H_5$ | $(CH_2)_2OH$ | 1 |
| CN | CN | H | CN | H | $C_6H_5$ | $[(CH_2)_2O]_2H$ | $(CH_2)_2COOCH_3$ | 1 |
| $NO_2$ | CN | H | $NO_2$ | H | $C_6H_5$ | $[(CH_2)_2O]_3H$ | $(CH_2)_2CN$ | 1 |
| $NO_2$ | CN | H | $NO_2$ | H | $C_6H_4$—4-$CH_3$ | $C_2H_5$ | $C_2H_5$ | 1 |
| $NO_2$ | $NO_2$ | H | CN | $CH_3$ | $C_6H_4$—4-$CH_3$ | $CH_2CH(OH)CH_2Cl$ | H | 1 |
| $NO_2$ | CN | H | $NO_2$ | H | $C_6H_4$—4-Cl | $CH_2CH(OH)CH_2Cl$ | $CH_2CH(OH)CH_2Cl$ | 1 |
| CN | CN | H | $NO_2$ | $O(CH_2)_2OH$ | $C_2H_5$ | $CH_2CH(OH)CH_2OH$ | $(CH_2)_2OH$ | 1 |
| CN | CN | H | $NO_2$ | $CH_3$ | $CH_3$ | $CH_2CH(OH)CH_2OCH_3$ | $(CH_2)_2COOCH_3$ | 1 |
| CN | CN | H | $NO_2$ | $CH_3$ | $CH_2OH$ | $(CH_2)_2OCH_2CH(OH)CH_2OH$ | $(CH_2)_2OCH_2CH(OH)CH_2OH$ | 1 |
| CN | CN | H | CN | H | $CH_3$ | $CH_2CH(OH)CH_2Cl$ | $(CH_2)_2COOC_2H_5$ | 1 |
| $NO_2$ | $NO_2$ | H | $SO_2CH_3$ | $OC_2H_5$ | $CH_2OH$ | $(CH_2)_2OCOCH_3$ | $(CH_2)_2OH$ | 1 |
| CN | CN | H | $SO_2CH_3$ | $O(CH_2)_2OCH_3$ | $CH_2OCH_3$ | $[(CH_2)_2O]_2H$ | $[(CH_2)_2O]_2H$ | 1 |
| $NO_2$ | CN | H | $SO_2C_2H_5$ | $CH_3$ | $CH_3$ | $CH_2CH(OH)CH_2OC_2H_5$ | $CH_2CH(OH)CH_2OC_2H_5$ | 1 |
| $COOCH_3$ | $NO_2$ | H | $NO_2$ | $O(CH_2)_2OH$ | $C_6H_5$ | $[(CH_2)_2O]_2C_2H_5$ | $[(CH_2)_2O]_2C_2H_5$ | 2 |
| $COOCH_3$ | $NO_2$ | H | $NO_2$ | $OC_2H_5$ | $CH_3$ | $[(CH_2)_2O]_3H$ | $[(CH_2)_2O]_3H$ | 2 |
| $COOC_2H_5$ | CN | H | $NO_2$ | $OCH_3$ | $CH_2O(CH_2)_2OC_2H_5$ | $(CH_2)_2CN$ | $[(CH_2)_2O]_2H$ | 2 |
| $CF_3$ | CN | H | $NO_2$ | $O(CH_2)_2OC_2H_5$ | $CH_3$ | $CH_2CH(OH)CH_2OH$ | $(CH_2)_2COOCH_3$ | 2 |
| CN | CN | H | $CF_3$ | H | $CH_2OH$ | $CH_2CH(OH)CH_2Cl$ | $(CH_2)_2COOCH_3$ | 3 |
| $NO_2$ | Br | H | $NO_2$ | $O(CH_2)_2OCH_3$ | $CH_3$ | $[(CH_2)_2O]_2CH_3$ | $[(CH_2)_2O]_2CH_3$ | 2 |
| $NO_2$ | Cl | H | $NO_2$ | $O(CH_2)_2OC_2H_5$ | $CH_3$ | $CH_2CH(OH)CH_2OH$ | H | 2 |
| $NO_2$ | $NO_2$ | H | $SO_2C_6H_5$ | H | $CH_3$ | $[(CH_2)_2O]_2C_2H_5$ | $[(CH_2)_2O]_2C_2H_5$ | 3 |
| $NO_2$ | CN | H | $SO_2C_6H_5$ | $O(CH_2)_2OCH_3$ | $(CH_2)_2OH$ | i-$C_4H_9$ | H | 3 |
| CN | CN | H | $COO(CH_2)_2OCH_3$ | $O(CH_2)_2OH$ | $C_2H_5$ | $(CH_2)_2OH$ | $(CH_2)_2OH$ | 1 |
| $NO_2$ | CN | H | $COO[(CH_2)_2O]_2C_2H_5$ | H | $C_6H_5$ | $[(CH_2)_2O]_2C_2H_5$ | $[(CH_2)_2O]_2C_2H_5$ | 3 |
| $NO_2$ | $NO_2$ | H | $COOCH_3$ | $OC_2H_5$ | $CH_2O(CH_2)_2OCH_3$ | $(CH_2)_2OH$ | $(CH_2)_2OH$ | 1 |

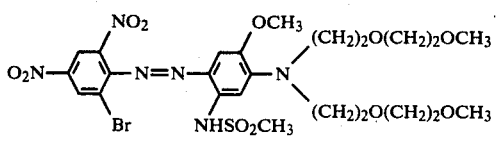

are used instead of 20 parts of the dyestuff of Example 1 and the procedure followed is in other respects as indicated in Example 1. This gives a navy blue print which has very good tinctorial properties, in particular good fastness to light, thermofixing, rubbing and washing, and which has a very good white ground with sharp outlines on the discharged areas.

EXAMPLE 4

20 parts of the dyestuff of the formula

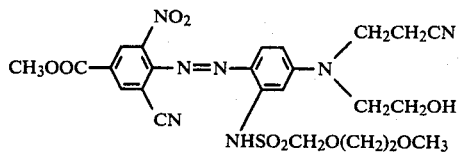

are used instead of 20 parts of the dyestuff of Example 1 and the procedure followed is in other respects as indicated in Example 1. This gives red prints which have very good tinctorial properties, in particular good fastness to light, fixing by dry heat, rubbing and washing, and have a very good white ground with sharp outlines.

EXAMPLE 5

20 parts of the dyestuff of the formula

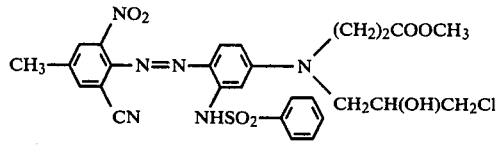

are used instead of 20 parts of the dyestuff of Example 1 and the procedure followed is in other respects as indicated in Example 1. This gives a red print which has very good tinctorial properties, in particular good fastness to light, fixing by dry heat, rubbing and washing, and has a very good white ground with sharp outlines.

Discharge reserve prints which have very good tinctorial properties are also obtained if equivalent quantities of the disperse dyestuffs indicated in the tables below are used in Examples 1 to 5 instead of the disperse dyestuffs indicated in those examples.

TABLE I-continued

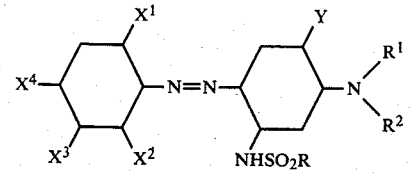

| $X^1$ | $X^2$ | $X^3$ | $X^4$ | Y | R | $R^1$ | $R^2$ | Shade |
|---|---|---|---|---|---|---|---|---|
| $NO_2$ | CN | H | $COOC_2H_5$ | H | $CH_2OH$ | $(CH_2)_2CN$ | $CH_2CH(OH)CH_2Cl$ | 3 |
| $NO_2$ | Br | H | $COO[(CH_2)_2O]_3H$ | H | $CH_3$ | $[(CH_2)_2O]_2H$ | $[(CH_2)_2O]_2H$ | 4 |
| $NO_2$ | CN | H | $COO[(CH_2)_2O]_2CH_3$ | $OC_2H_5$ | $C_6H_5$ | $[(CH_2)_2O]_2C_2H_5$ | $[(CH_2)_2O]_2C_2H_5$ | 1 |
| $NO_2$ | $NO_2$ | H | $COO[(CH_2)_2O]_3C_2H_5$ | $OCH_3$ | $C_6H_4$—4-$CH_3$ | $[(CH_2)_2O]_2H$ | $(CH_2)_2CN$ | 2 |
| $NO_2$ | CN | H | $CONH(CH_2)_3OCH_3$ | H | $CH_3$ | $CH_2CH(OH)CH_2OC_2H_5$ | H | 4 |
| $NO_2$ | CN | H | CONHi-$C_3H_7$ | H | n-$C_4H_9$ | $[(CH_2)_2O]_3CH_3$ | $[(CH_2)_2O]_3CH_3$ | 3 |
| $NO_2$ | CN | H | $CON[(CH_2)_2OC_2H_5]_2$ | H | $CH_3$ | i-$C_3H_7$ | $[(CH_2)_2O]_3H$ | 5 |
| $NO_2$ | CN | H | $SO_2NH_2$ | H | $CH_2O(CH_2)_2OC_2H_5$ | $[(CH_2)_2O]_3H$ | $(CH_2)_2COOCH_3$ | 5 |
| CN | CN | H | $SO_2NH_2$ | H | $CH_2OCH_3$ | $CH_2CH(OH)CH_2Cl$ | H | 5 |
| $NO_2$ | CN | H | $SO_2NH(CH_2)_3OCH_3$ | H | $CH_3$ | $CH_2CH(OH)CH_2OCH_3$ | H | 5 |
| CN | CN | H | $SO_2NH[(CH_2)_2O]_2C_2H_5$ | H | $C_6H_5$ | $[(CH_2)_2O]_2C_2H_5$ | H | 5 |
| $NO_2$ | CN | H | $SO_2NH[(CH_2)_2O]_3H$ | H | $C_6H_4$—4-$CH_3$ | $[(CH_2)_2O]_2H$ | $[(CH_2)_2O]_2H$ | 5 |
| $NO_2$ | $NO_2$ | H | $SO_2NHn$-$C_4H_9$ | H | $CH_3$ | $CH_2CH(OH)CH_2Cl$ | $(CH_2)_2OH$ | 5 |
| $NO_2$ | Br | H | $SO_2NH(CH_2)_4OCH_3$ | H | $C_6H_5$ | $CH_2CH(OH)CH_2O(CH_2)_2OCH_3$ | H | 5 |
| $NO_2$ | CN | H | $SO_2NH$i-$C_3H_7$ | NHi-$C_{C6}H_5$ | $CH_2CH(OH)CH_2Cl$ | H | 5 | |
| $NO_2$ | Cl | H | $SO_2NH[(CH_2)_2O]_2CH_3$ | H | $C_6H_5$ | i-$C_4H_9$ | $(CH_2)_2OH$ | 5 |
| $NO_2$ | $NO_2$ | H | $SO_2N[(CH_2)_3OCH_3]_2$ | H | $CH_3$ | $CH_2CH(OH)CH_2Cl$ | $CH_2CH(OH)CH_2Cl$ | 5 |
| CN | CN | H | $SO_2N[(CH_2)_2OCH_3]_2$ | H | $C_2H_5$ | $[(CH_2)_2O]_2C_2H_5$ | $(CH_2)_2COOCH_3$ | 5 |
| $NO_2$ | CN | H | $SO_2N\{[(CH_2)_2O]_2C_2H_5\}_2$ | H | $C_6H_5$ | $(CH_2)_2OH$ | H | 5 |
| CN | CN | H | Cl | H | $CH_2OCH_3$ | $CH_2CH(OH)CH_2Cl$ | $(CH_2)_2COOCH_3$ | 5 |
| $NO_2$ | CN | H | Cl | H | $CH_3$ | $CH_2CH(OH)CH_2OCH_3$ | $CH_2CH(OH)CH_2OCH_3$ | 5 |
| $NO_2$ | CN | H | Cl | H | $C_6H_5$ | $[(CH_2)_2O]_3H$ | $[(CH_2)_2O]_3H$ | 5 |
| $NO_2$ | $NO_2$ | H | Br | H | $(CH_2)_2OH$ | $CH_2CH(OH)CH_2OH$ | $(CH_2)_2COOCH_3$ | 5 |
| $NO_2$ | CN | H | Br | H | $CH_3$ | $CH_2CH(OH)CH_2Cl$ | $C_2H_5$ | 5 |
| $NO_2$ | CN | H | $CH_3$ | H | $CH_2OH$ | $CH_2CH(OH)CH_2Cl$ | $(CH_2)_2COOC_2H_5$ | 5 |
| $NO_2$ | $NO_2$ | H | $CH_3$ | H | $CH_2OH$ | $CH_2CH(OH)CH_2OCH_3$ | $(CH_2)_2OH$ | 5 |
| $NO_2$ | $NO_2$ | H | $C_2H_5$ | H | $C_6H_5$ | $[(CH_2)_2O]_2CH_3$ | $[(CH_2)_2O]_2CH_3$ | 5 |
| $NO_2$ | CN | H | $COCH_3$ | H | $C_2H_5$ | $(CH_2)_2OH$ | $(CH_2)_2COOCH_3$ | 4 |
| $NO_2$ | $NO_2$ | H | $COCH_3$ | $CH_3$ | $CH_2OC_2H_5$ | $(CH_2)_2OCOCH_3$ | $(CH_2)_2OH$ | 3 |
| CN | CN | H | $COC_2H_5$ | H | $CH_3$ | $(CH_2)_2OCH_2CH(OH)CH_2Cl$ | $(CH_2)_2OH$ | 4 |
| CN | CN | H | H | H | $CH_2O(CH_2)_2OCH_3$ | $CH_2CH(OH)CH_2OH$ | $(CH_2)_2OH$ | 5 |
| CN | CN | H | H | H | $(CH_2)_2OH$ | $[(CH_2)_2O]_2H$ | $[(CH_2)_2O]_2H$ | 5 |
| $NO_2$ | CN | H | $COOC_6H_5$ | $O(CH_2)_2OCH_3$ | $CH_3$ | $[(CH_2)_2O]_2H$ | $[(CH_2)_2O]_2H$ | 1 |
| $NO_2$ | $NO_2$ | H | $COC_6H_5$ | $CH_3$ | $C_6H_5$ | $[(CH_2)_2O]_2C_2H_5$ | $[(CH_2)_2O]_2C_2H_5$ | 3 |
| CN | CN | H | CO—4-$NO_2C_6H_4$ | Cl | $(CH_2)_2OH$ | $CH_2CH(OH)CH_2(OH)$ | H | 3 |
| CN | CN | Br | $NO_2$ | $OCH_3$ | $CH_3$ | $(CH_2)_2OH$ | $(CH_2)_2OCOCH_3$ | 1 |
| CN | CN | Cl | $NO_2$ | $OC_2H_5$ | $C_2H_5$ | $[(CH_2)_2O]_2H$ | $[(CH_2)_2O]_2H$ | 1 |
| CN | CN | $NO_2$ | Cl | H | $CH_3$ | $[(CH_2)_2O]_2H$ | $(CH_2)_2COOCH_3$ | 4 |
| $NO_2$ | CN | $NO_2$ | Cl | Cl | $C_6H_5$ | $[(CH_2)_2O]_3H$ | $[(CH_2)_2O]_3H$ | 4 |

TABLE 2

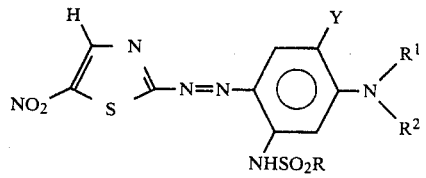

| Y | R | $R^1$ | $R^2$ | Shade |
|---|---|---|---|---|
| H | $CH_3$ | $(CH_2)_2OH$ | $(CH_2)_2COOCH_3$ | 3 |
| H | $C_6H_5$ | $[(CH_2)_2O]_2H$ | $(CH_2)_2COOCH_3$ | 3 |
| H | $CH_3$ | $[(CH_2)_2O]_2C_2H_5$ | $[(CH_2)_2O]_2C_2H_5$ | 3 |
| $CH_3$ | $C_6H_5$ | $CH_2CH(OH)CH_2OH$ | H | 1 |
| $CH_3$ | $CH_3$ | $[(CH_2)_2O]_2H$ | $[(CH_2)_2O]_2H$ | 1 |
| $OCH_3$ | $CH_3$ | $(CH_2)_2OH$ | $(CH_2)_2COOCH_3$ | 1 |
| $OC_2H_5$ | $CH_3$ | $(CH_2)_2OH$ | $(CH_2)_2OH$ | 1 |
| $O(CH_2)_2OCH_3$ | $CH_3$ | $CH_2CH(OH)CH_2OCH_3$ | H | 1 |

TABLE 3

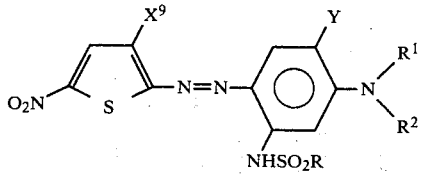

| $X^9$ | Y | R | $R^1$ | $R^2$ | Shade |
|---|---|---|---|---|---|
| $NO_2$ | H | $CH_3$ | $(CH_2)_2CN$ | $(CH_2)_2OH$ | 1 |
| $NO_2$ | H | $(CH_2)_2OH$ | $(CH_2)_2OH$ | $(CH_2)_2OH$ | 1 |
| $NO_2$ | H | $CH_3$ | $CH_2CH(OH)CH_2OH$ | H | 1 |
| CN | H | $CH_3$ | $(CH_2)_2OH$ | $(CH_2)_2COOCH_3$ | 1 |
| CN | H | $C_6H_5$ | $[(CH_2)_2O]_2H$ | $[(CH_2)_2O]_2H$ | 1 |
| $COOCH_3$ | H | $CH_3$ | $(CH_2)_2OH$ | $(CH_2)_2OH$ | 1 |
| $COOCH_3$ | H | $CH_2O(CH_2)_2OH$ | $C_2H_5$ | $C_2H_5$ | 1 |
| $NO_2$ | H | $C_2H_5$ | $C_2H_5$ | $C_2H_5$ | 1 |
| $NO_2$ | H | $CH_3$ | $C_2H_5$ | $C_2H_5$ | 1 |
| $NO_2$ | H | $CH_3$ | $C_2H_5$ | $(CH_2)_2COOCH_3$ | 1 |
| $NO_2$ | H | $CH_3$ | n-$C_3H_7$ | n-$C_3H_7$ | 1 |
| $NO_2$ | H | $CH_3$ | $(CH_2)_2OCOCH_3$ | $(CH_2)_2OCOCH_3$ | 1 |

TABLE 4

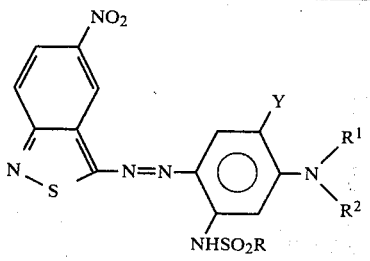

| Y | R | $R^1$ | $R^2$ | Shade |
|---|---|---|---|---|
| H | $CH_3$ | $(CH_2)_2OH$ | $(CH_2)_2OH$ | 1 |
| H | $CH_3$ | $(CH_2)_2OH$ | $(CH_2)_2OCOCH_3$ | 1 |
| H | $C_6H_5$ | $[(CH_2)_2O]_2CH_3$ | $[(CH_2)_2O]_2CH_3$ | 1 |
| H | $CH_2OH$ | $C_2H_5$ | $C_2H_5$ | 1 |
| $CH_3$ | $CH_3$ | $CH_2CH(OH)CH_2OH$ | H | 1 |
| $CH_3$ | $CH_3$ | $(CH_2)_2OH$ | $(CH_2)_2COOCH_3$ | 1 |
| $OC_2H_5$ | $CH_3$ | $(CH_2)_2OH$ | $(CH_2)_2OCOCH_3$ | 1 |

TABLE 5

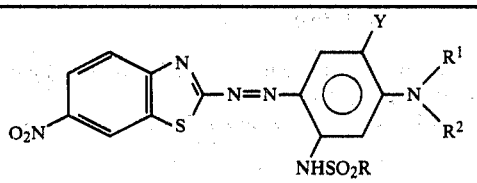

| Y | R | $R^1$ | $R^2$ | Shade |
|---|---|---|---|---|
| H | $CH_3$ | $[(CH_2)_2O]_2H$ | $[(CH_2)_2O]_2H$ | 3 |
| $CH_3$ | $CH_3$ | $CH_2CH(OH)CH_2OC_2H_5$ | H | 3 |
| $CH_3$ | $CH_3$ | $(CH_2)_2OH$ | $(CH_2)_2OCOCH_3$ | 1 |
| $O(CH_2)_2OCH_3$ | $C_6H_5$ | $C_2H_5$ | $(CH_2)_2OH$ | 1 |

The colour shade on polyester is indicated in the last columns of the above tables. The numbers have the following meanings:

1=blue
2=navy blue
3=violet
4=ruby
5=red

What is claimed is:

1. In the process for production of discharge reserve prints on textile material comprised of water-repellent fibers or water repellent fibers mixed with cellulose fibers, wherein a disperse dyestuff which is dischargeable to white is applied in the form of a dye liquor or printing paste to the incipiently dried, and a discharge reserve printing paste is printed on the material in the desired pattern, and the thus treated material is subsequently subjected to a heat treatment at temperatures of 100° to 230° C. and wherein said disperse dyestuff which is dischargeable to white is a dyestuff of the formula

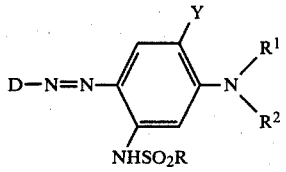

wherein R is unsubstituted or substituted alkyl having 1 to 4 carbon atoms which when substituted is substituted by hydroxyl, chloro, bromo, methoxy, methoxyethoxy or ethoxyethoxy or R is phenyl or phenyl substituted by at least one of nitro, chlorine, bromine and methyl;

$R^1$ is alkyl having 1 to 4 carbon atoms which is unsubstituted or substituted by hydroxyl, chloro, bromo, cyano, phenyl, phenoxy, alkylaminocarbonyloxy having 1 to 4 carbon atoms in the alkyl moiety or phenylaminocarbonyloxy, or $R^1$ is dihydroxyalkyl having 3 or 4 carbon atoms, chlorohydroxyalkyl having 3 or 4 carbon atoms, or alkyl having 3 to 10 carbon atoms with the carbon chain interrupted by 1 to 3 oxygen atoms and which is unsubstituted or substituted by at least one hydroxyl;

$R^2$ is independently a moiety as defined for $R^1$ or $R^2$ is hydrogen, cyclopentyl, cyclohexyl, phenyl, or alkenyl having 3 to 5 carbon atoms;

Y is hydrogen, chloro, bromo, alkyl having 1 to 4 carbon atoms, alkoxy which has 1 to 4 carbon atoms which is unsubstituted or substituted by cyano or hydroxyl, or Y is dihydroxyalkoxy having 3 or 4 carbon atoms, chlorohydroxyalkyl having 3 or 4 carbon atoms, or alkoxy having 3 to 10 carbon atoms with the carbon chain interrupted by 1 to 3 oxygen atoms and which is unsubstituted or substituted by hydroxyl;

D is a moiety selected from the group consisting of

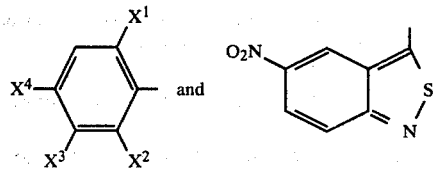

wherein $X^1$ nitro, cyano, alkylsulphonyl having 1 to 4 carbon atoms, phenylsulphonyl, dialkylphosphono having 1 to 4 carbon atoms in each alkyl moiety or trifluoromethyl;

$X^2$ is nitro, cyano, alkylsulphonyl having 1 to 4 carbon atoms, phenylsulphonyl, dialkylphosphono having 1 to 4 carbon atoms in each of alkyl moiety, bromo, chloro or fluoro;

$X^3$ is hydrogen, chloro, bromo, fluoro or nitro;

$X^4$ is hydrogen, chloro, bromo, fluoro, methyl, ethyl, nitro, cyano, alkylsulphonyl having 1 to 4 carbon atoms, phenylsulphonyl, trifluoromethyl, aminocarbonyl, alkylaminocarbonyl having 1 to 4 carbon atoms in the alkyl moiety and which is unsubstituted or substituted by hydroxyl, alkylaminocarbonyl having 3 to 10 carbon atoms in the alkyl moiety and which is interrupted by up to 3 oxygen atoms, dialkylaminocarbonyl having 1 to 4 carbon atoms in each alkyl moiety which is unsubstituted or substituted by hydroxyl, dialkylaminocarbonyl having 3 to 10 carbon atoms in each alkyl moiety and which are interrupted by up to 3 oxygen atoms, aminosulphonyl, alkylaminosulphonyl having 1 to 4 carbon atoms which is unsubstituted or substituted by hydroxyl, alkylaminosulphonyl having 3 to 10 carbon atoms and with the carbon chain interrupted by up to 3 oxygen atoms, dialkylaminosulphonyl having 1 to 4 carbon atoms in each of the alkyl moieties, dialkylaminosulphonyl having 3 to 10 carbon atoms in each alkyl moiety, with each of which interrupted by up to 3 oxygen atoms, alkylcarbonyl having 1 to 4 carbon atoms in the alkyl moiety, phenylcarbonyl unsubstituted or substituted by at least one of nitro, chloro, bromo, methoxy or methyl, with the proviso that not more than 3 of $X^1$ to $X^4$ are nitro or cyano, the improvement comprising said discharge reserve printing paste containing, as the discharging agent, a base which produces a pH value of at least 8 in a 5% strength aqueous solution.

2. The process according to claim 1 wherein the textile material is impregnated with a padding liquor.

3. The process according to claim 2 wherein the textile material is polyester/cellulose mixed fabric and a padding liquor or printing paste additionally contains at least one further dischargeable reactive dyestuff having a reactive moiety of the formula selected from the group consisting of $-SO_2-CH_2-CH_2-Hal$,
$-SO_2-CH_2-CH_2-O-SO_3X$,
$-NH-SO_2-CH_2-CH_2-OSO_3X$, and
$-SO_2-CH=CH_2$ wherein X is hydrogen or metal cation, and Hal is halogen.

4. The process according to claim 3 wherein the metal cation is a sodium ion and Hal is chloro or bromo.

5. The process according to claim 3 wherein the heat treatment is at temperatures of 100° to 110° C.

6. The process according to claim 1 wherein said base of the discharge reserve printing paste is an alkali metal carbonate or bicarbonate.

7. The process according to claim 6 wherein said base is sodium carbonate.

8. The process according to claim 1 wherein said disperse dyestuff comprises a mixture of 2 or more dyestuffs of said formula.

9. The process according to claim 1 wherein either $R^1$ or $R^2$ or both $R^1$ and $R^2$ have at least one hydroxyl.

10. The process according to claim 1 wherein at least one of $R^1$ and $R^2$ is $[CH_2CH_2O]_{m(CH2)_n}H$ wherein m is the number 1, 2, 3 or 4 and n is the number 0, 1, 2, 3 or 4.

11. The process according to claim 1 wherein D is

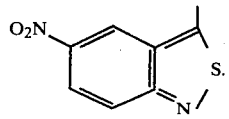

12. The process according to claim 1 wherein D is

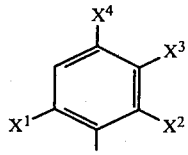

wherein $X^4$ is nitro, cyano, methylsulphonyl, ethylsulphonyl, or $X^4$ is aminosulphonyl, alkylaminosulphonyl having 1 to 4 carbon atoms and which is unsubstituted or substituted by hydroxyl, or $X^4$ is alkylaminosulphonyl having 3 to 10 carbon atoms with the carbon chain interrupted by 1 to 3 oxygen atoms, or $X^4$ is acetyl, propionyl, trifluoromethyl, fluoro, chloro, bromo, methyl or hydrogen;

$X^1$ and $X^2$ independent of one another are nitro, methylsulphonyl, ethylsulphonyl or cyano;

and $X^3$ is hydrogen, chloro or nitro.

* * * * *